US006474362B1

(12) United States Patent
Hope et al.

(10) Patent No.: US 6,474,362 B1
(45) Date of Patent: Nov. 5, 2002

(54) LATCHING HYDROSEAL VALVE

(75) Inventors: Rodney C. Hope, Sugar Land, TX (US); Thomas W. Neugebauer, Houston, TX (US); Rick Whorton, Willow Pine, TX (US)

(73) Assignee: Gilmore Valve Co., Ltd., Houston, TX (US)

( * ) Notice: Subject to any disclaimer, the term of this patent is extended or adjusted under 35 U.S.C. 154(b) by 0 days.

(21) Appl. No.: 09/957,208

(22) Filed: Sep. 20, 2001

(51) Int. Cl.[7] ..... F15B 13/043
(52) U.S. Cl. ..... 137/625.64; 91/426; 137/625.66
(58) Field of Search ..... 91/426; 137/625.64, 137/625.66

(56) References Cited

U.S. PATENT DOCUMENTS

| | | | | |
|---|---|---|---|---|
| 4,185,661 A | | 1/1980 | Gill et al. | |
| 4,258,749 A | | 3/1981 | Mayer | |
| 4,355,661 A | | 10/1982 | Mayer | |
| 4,450,869 A | * | 5/1984 | Acker | 137/625.66 |
| 4,601,311 A | * | 7/1986 | Acker | 137/625.66 |
| 4,611,632 A | | 9/1986 | Kolchinsky et al. | |
| 4,848,404 A | * | 7/1989 | Hickok | 137/625.66 |
| 5,711,347 A | | 1/1998 | Sturman et al. | |
| 5,810,047 A | | 9/1998 | Kirkman | |
| 5,937,904 A | | 8/1999 | Wunder | |
| 6,116,276 A | | 9/2000 | Grill | |
| 6,167,909 B1 | * | 1/2001 | Davis | 137/625.66 |
| 6,276,396 B1 | * | 8/2001 | Kirkman | 137/625.66 |

FOREIGN PATENT DOCUMENTS

| | | |
|---|---|---|
| GB | 2311347 | 9/1997 |
| GB | 2344405 | 4/1999 |
| GB | 2329945 | 6/2000 |

OTHER PUBLICATIONS

SCANA Rotator AS, Hydraulic Directional Control Valves, pp. 1–17, Nodeland, Norway.

* cited by examiner

*Primary Examiner*—Gerald A. Michalsky
(74) *Attorney, Agent, or Firm*—Blackwell Sanders Peper Martin LLP

(57) ABSTRACT

The normally closed, two-position, three-way latching hydroseal valve can be used in subsea applications in connection with the production of oil and natural gas. The latching hydroseal valve can be operated by remote pilot valves to open and close the latching hydroseal valve or in an alternative embodiment attached solenoid pilot valves can be used. The seal carrier has pistons of different diameters to latch the valve open after the pilot fluid is vented to atmosphere. The main seal assembly includes a bi-directional seal.

23 Claims, 8 Drawing Sheets

LATCHING HYDROSEAL VALVE

BACKGROUND OF THE INVENTION.

1) Field of the Invention

The latching hydroseal valve is a normally closed two-position, three-way valve. The latching hydroseal valve can be installed on or in a control pod that operates a Christmas tree, which is installed on a subsea wellhead for production of oil and/or gas. The control pod will typically include more than a dozen latching hydroseal valves used for various control functions. The latching hydroseal valve is connected to a source of pressurized pilot fluid and a downstream apparatus. The latching hydroseal valve is also connected to a source of pressurized supply fluid to selectively direct such supply fluid to a downstream apparatus in response to fluid signals from the pilot fluid. A typical downstream apparatus is a valve actuator. The actuator typically controls a gate valve, which regulates well flow through the tree.

2) Description of Related Art

The latching hydroseal valves of the present invention are rated for operational pressure up to 20,000 psi and are designed to operate in sea water that is up to 10,000 feet deep. Competitive products sometimes referred to as directional control valves are currently manufactured by Mandeville Engineering Limited of Maidenhead, Berkshire, U.K.; Scana Rotator as, of Nodeland, Norway (the U.S. subsidiary is Scana Industries, Inc. of Houston, Tex.); Tactair Fluid Controls, Inc. of Liverpool, N.Y.; Cameron Controls and ABB Seatech Controls.

An advertising brochure for hydraulic directional control valves from Scana Rotator is included in the Information Disclosure Statement filed concurrently herewith Scana produces a number of different hydraulic directional control valves at least one of which is similar to the present invention, model number 91.11.11.13-3.2. A section drawing from Scana of this directional control valve is likewise included in the Information Disclosure Statement. The Scana directional control valve model number 91.11.11.13-3.2 is used in similar situations to the present invention. However, this particular Scana valve uses a large number of seals and the design is complicated and expensive to manufacture. The present invention uses a bi-directional seal which results in fewer total seals and ultimately reduces the chance of leakage. In addition, the design of the present invention is less complicated and more economical to manufacture.

U.S. Pat. No. 6,116,276 issued to Grill, discloses a dynamically balanced, latching fluid valve. This valve includes a solenoid and spring assembly sealed by a pair of seals that each have an effective area approximately equal to the effective area of the valves. Activation of the solenoid moves a tube and valve from a first position allowing fluid communication between a cylinder port and a supply port and then to a second position, allowing fluid communication between a cylinder port and a return port. The spring latches the valve to the first position. The solenoid is actuated by short digital pulses that latch the transfer tube and valve into position. The Grill valve is apparently formed of plastic and is used for purposes such as in applications of insecticides. It is unlikely to be suitable for subsea applications.

U.S. Pat. Nos. 4,258,749 and 4,355,661 to Mayer disclose pneumatic pressure control valves having two oppositely acting solenoids. The structures disclosed in the Mayer patents include a central valve body which interposes two housing sections, each having a central member functioning as a valve guide and each housing also being adapted to mate with one of two ends of the central valve body. Thus, sandwiching one of two independently actuatable solenoids therebetween. The solenoids cooperate with a central valve body and housing section to form an actuation chamber. Each solenoid contains a movable element of the house slidably disposed with each actuation chamber and each valve guide. This device is intended to solve problems related to control valves, especially pneumatic control valves to modulate the fluid pressure applied to vacuum actuators. It can also be modified for use as an on-off control valve using only a single solenoid.

The latching hydroseal valve of the present invention has a latching function that is achieved through differential diameters in the seal carrier. In addition, the present invention has a bi-directional seal. Fewer seals in the present invention reduces the chance of leakage when compared to prior art designs. The present invention is also less complex and more economical to produce than prior designs.

SUMMARY OF THE INVENTION

The latching hydroseal valve is a normally closed, two-position, three way valve. The latching hydroseal valve is connected to at least one source of pressurized pilot fluid and a downstream apparatus. The latching hydroseal valve is also connected to a source of pressurized supply fluid to selectively direct such supply fluid to a downstream apparatus in response to fluid signals from one or more pilot valves.

Typically the latching hydroseal valve is connected to two upstream pilot valves. Actuation of one pilot valve opens the latching hydroseal valve and actuation of the other pilot valve closes the latching hydroseal valve. Typically the upstream pilot valves are normally closed, two-position, three way valves. In modem systems, these two position, three way pilot valves are typically pulsed or actuated for approximately 2–3 seconds and then they are turned off. When they are turned off, they vent the pilot fluid. The pilot fluid between the pilot valve and the latching hydroseal valve is vented to atmosphere as well as the pilot fluid in the latching hydroseal valve itself. The present invention has a latching feature that will allow the latching hydroseal valve to stay in the open position when the pilot vents to atmosphere. The latching hydroseal valve will not close until the other pilot valve is actuated; unless there is a failure of supply pressure.

In more modern designs, a single pilot dual pulse spool valve may also be suitable for controlling the latching hydroseal valve in lieu of two upstream pilot valves. The single pilot dual pulse spool valve is disclosed in U.S. patent application Ser. No. 09/948,846, Filed on Sep. 7, 2001, and is incorporated herein by reference. The single pilot dual pulse spool valve patent application is owned by Gilmore Valve Co., the assignee of the present application.

In an alternative embodiment, two solenoid pilot valves are connected to the latching hydroseal valve and a source of pressurized pilot fluid. The latching hydroseal valve is also connected to a source of pressurized supply fluid to selectively direct such supply fluid to a downstream apparatus in response to fluid signals from the solenoid pilot valves.

The latching hydroseal valve has a main seal assembly with a bi-directional seal. This bi-directional seal reduces the total number of total seals required in the valve and allows for a more simple design than the prior art. The chance of leakage and malfunction has been reduced in the present invention because the total number of seals has been reduced. In addition, the present invention is a more simple design that is easier and more economical to produce than the prior art.

The latching hydroseal valve can be produced with or without a close assembly. In the preferred embodiment, the latching hydroseal valve is produced with a close assembly to guard against unexpected drops in supply pressure. The purpose of the close assembly is to close the latching hydroseal valve if supply pressure unexpectedly falls below a minimum set pressure. The close assembly can be manually adjusted in the field by rotation of an elongate adjusting bolt to raise or lower the set pressure. In an alternate embodiment, the close assembly is not manually adjustable in the field. In this alternative embodiment, the spring itself determines the set pressure. The set pressure is predetermined during manufacture of the valve by selection of an appropriate spring.

BRIEF DESCRIPTION OF THE DRAWINGS

In FIG. 4 the latching hydroseal valve is shown in the normally closed position.

In FIG. 5, the latching hydroseal valve is shown in the open position.

In FIG. 11, the latching hydroseal valve is in the normally closed position. This valve includes a close assembly that can be manually adjusted in the field to raise or lower the set pressure.

DETAILED DESCRIPTION OF THE INVENTION

Figure 1:
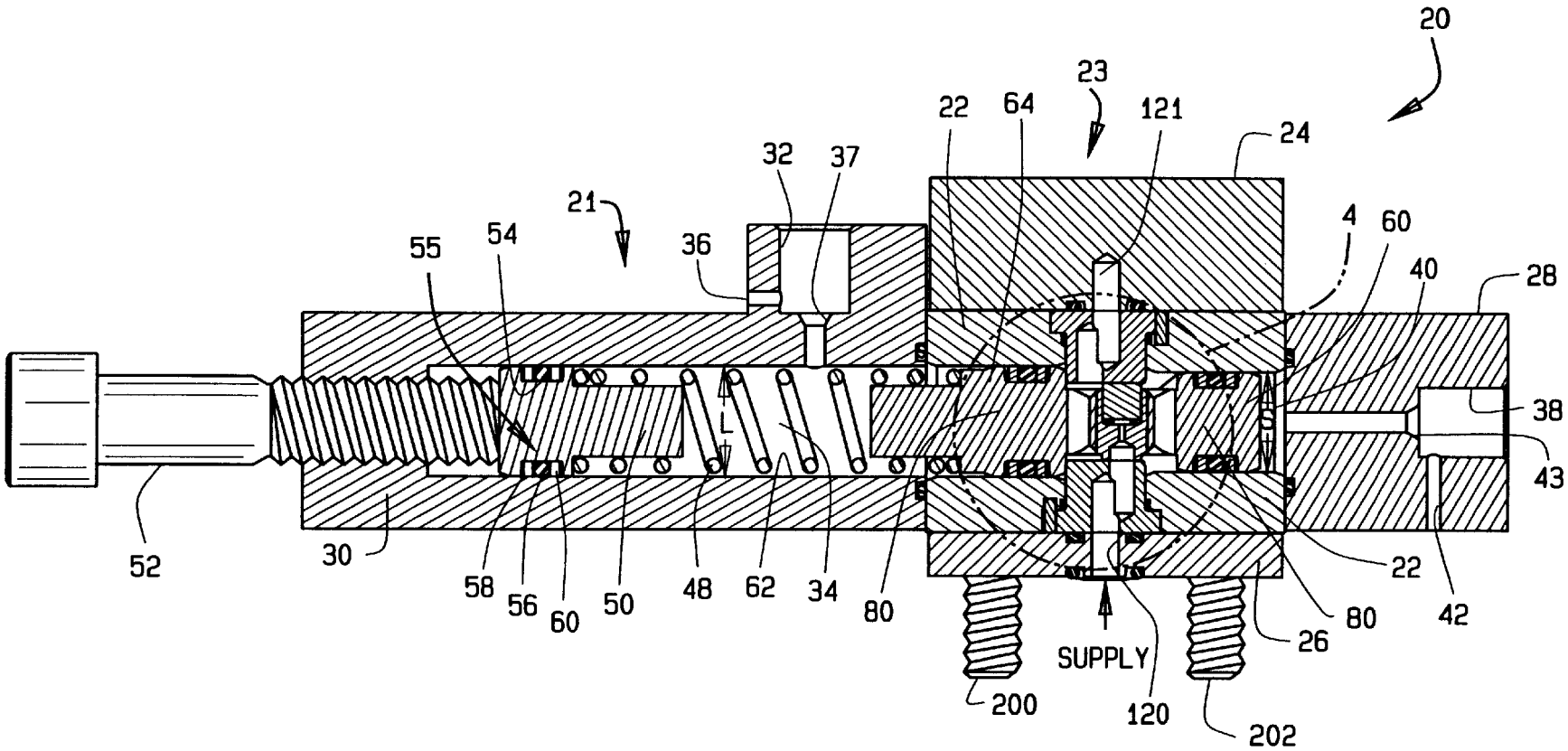
FIG. 1 is a cross-sectional view of the latching hydroseal valve shown in the closed position. The valve has an integral close assembly that can be manually adjusted in the field to raise or lower the set pressure in the event of an unexpected drop in supply pressure.
Figure 6:
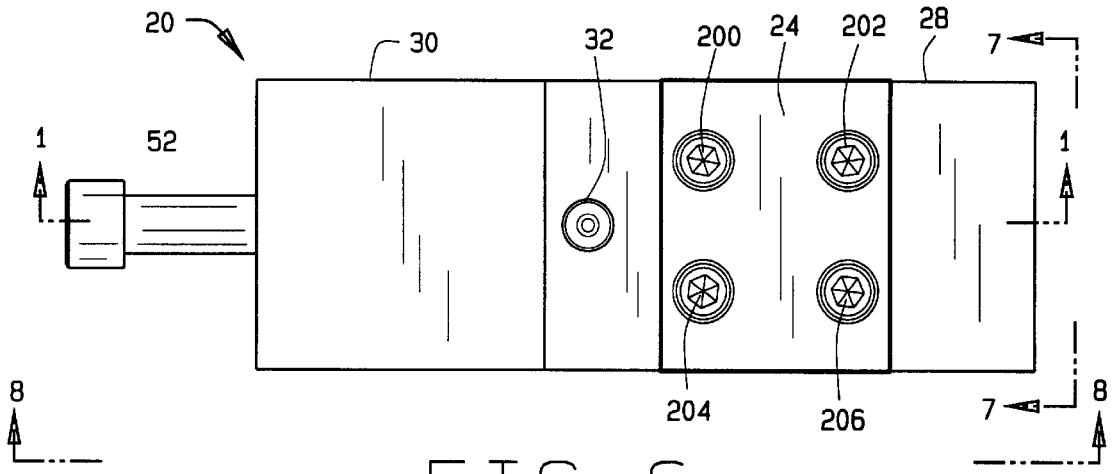
FIG. 6 is a top plan view of the latching hydroseal valve of FIG. 1.

FIG. 1 is a section view of the latching hydroseal valve generally identified by the numeral 20 along the line 1—1 of FIG. 6. The latching hydroseal valve 20 is a normally closed two-position, three-way valve. The valve 20 is rated to operate up to 20,000 psi and in water depths up to 10,000 feet. The valve is commonly used on control pods on subsea Christmas trees for production of oil and/or natural gas. A typical control pod on a subsea Christmas tree could include a dozen or more latching hydroseal valves 20.

The latching hydroseal valve 20 is connected to a source of supply fluid, not shown which is typically pressurized to approximately 5–10,000 psi. The valve 20 is also connected to a source of pilot fluid, not shown, which is typically pressurized to approximately 3–10,000 psi. The valve 20 in FIG. 1 includes a close assembly generally identified by the numeral 21 that can be manually adjusted in the field to raise or lower the set pressure of the valve. If the supply pressure unexpectedly drops below a set pressure for example approximately 750 psi, the valve 20 closes. This is to guard against unanticipated failure of supply pressure. The valve 20 can be produced with a manually adjustable close assembly 21 as shown in FIG. 1 or in an alternative embodiment a non-adjustable version shown in FIG. 12. In yet another alternative embodiment, not shown, the valve can be produced without a close assembly, although this is not preferred. embodiment, not shown, the valve can be produced without a close assembly, although this is not preferred.

A central block 22 is located in the middle of the valve 20. A top plate 24 is positioned on the top of the central block and a bottom plate 26 is positioned on the bottom of the central block 22. The top plate 24 and the bottom plate 26 are connected to the central block 22 with a plurality of bolts that will be discussed below.

An adapter 28 is connected to the central block 22 and a spring housing 30 is connected to the central block 22 opposite the adapter 28. For purposes of claim interpretation the central block 22, the top plate 24, the bottom plate 26, the adapter 28 and the spring housing 30 will collectively be referred to as the body 23.

A pilot close port 32 is formed in the spring housing 30 and is in fluid communication with the close chamber 34. The pilot close port 32 is configured with MP (medium pressure) threads and must have a vent 36 so if leakage occurs past the taper 37 the leak will exit through the vent 36 and will not blow out a fitting, not shown, in the pilot close port 32. Typically, an upstream pilot valve is connected by tubing, not shown, and a fitting, not shown, to the pilot close port 32.

The adapter 28 defines a pilot open port 38, which is in fluid communication with an open chamber 40. Likewise, the pilot open port 38 has MP threads that must have a vent 42 so if leakage occurs past the taper 43, pressure will exit through the vent 42 and not blow out a fitting, not shown, in the pilot open port 38. Other types of threads may be used in the pilot close port 32 and the pilot open port 38, as a matter of design choice.

Figure 4:
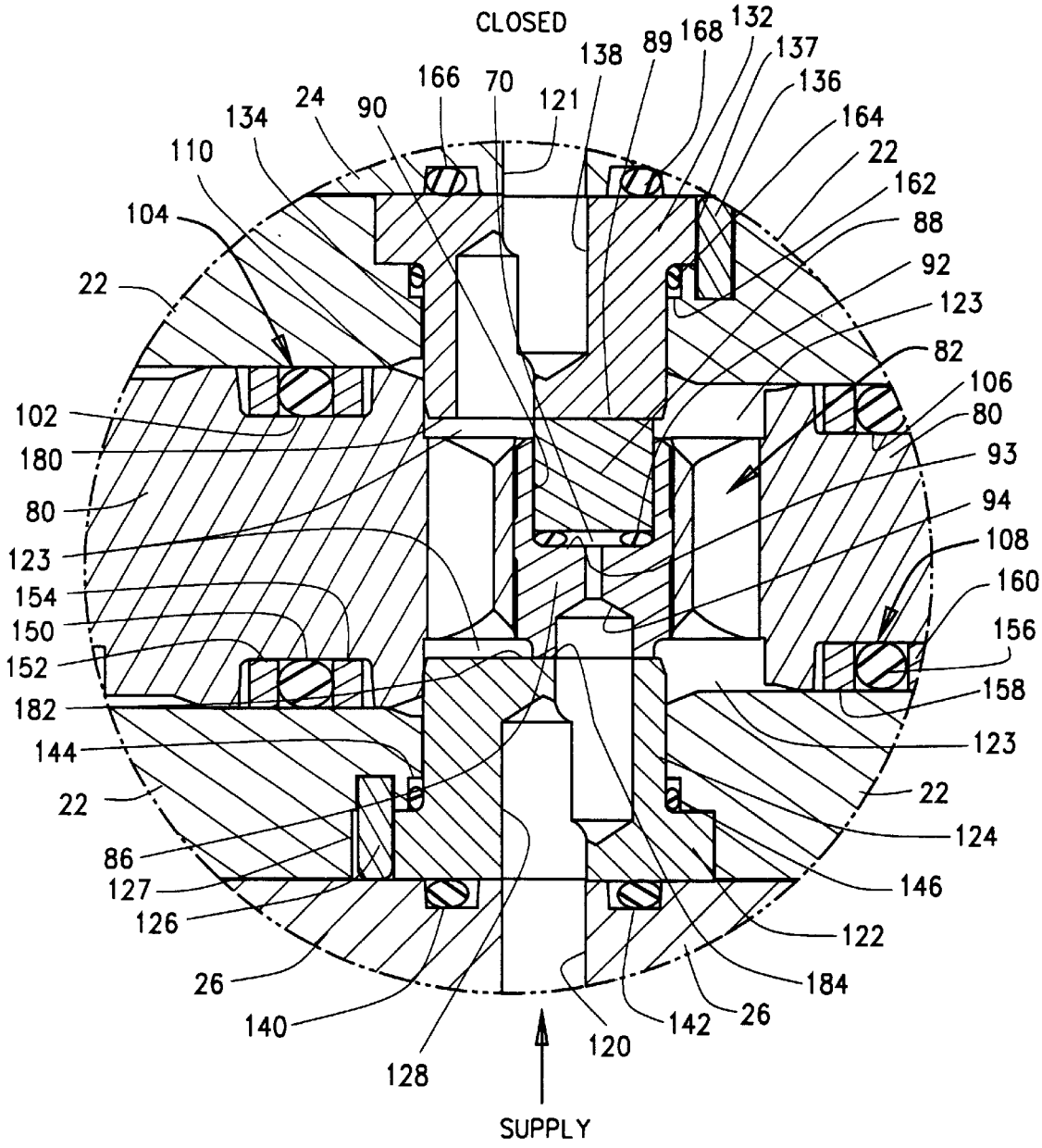
FIG. 4 is an enlarged section view of the main seal assembly, seal carrier and other components identified by the line 4 in FIG. 1.
Figure 5:
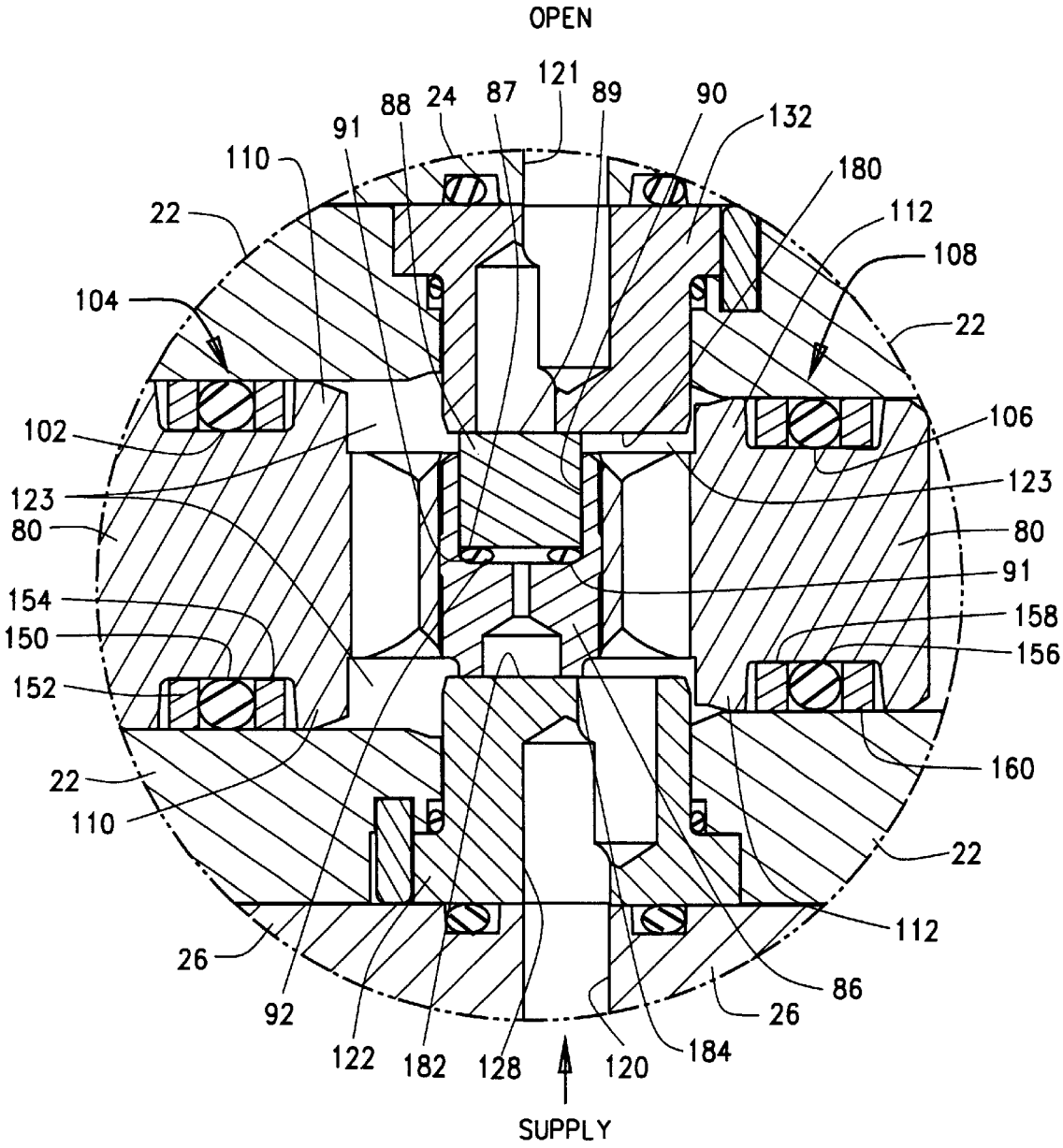
FIG. 5 is an enlarged section view of the seal assembly, the seal carrier and other components.

Typically an upstream pilot valve, not shown, is connected by tubing, not shown, and a fitting, not shown, to the pilot open port 38. To operate the valve 20, the pilot, not shown, is actuated allowing pilot fluid to enter the open chamber 40 and shift the seal carrier 80 into the open position as shown in FIG. 5. After the pilot valve is closed, the pilot fluid in the open chamber 40 is vented through the pilot valve, not shown. To close the valve 20, a second pilot valve, not shown, is activated allowing pilot fluid to enter the close chamber 34 and shift the seal carrier 80 into the closed position as shown in FIG. 1 and 4.

Inside the close chamber 34 is an elongate spring 48, one end of which engages the spring guide 50. The spring guide 50 is slideably mounted in the close chamber 34. An elongate adjusting bolt 52 threadably engages the spring housing 30. Rotation of the bolt clockwise raises the set pressure of the valve 20 and rotation of the adjusting bolt 52 counterclockwise lowers the set pressure of the valve 20.

A channel 54 is formed in the circumference of the spring guide 50 and is sized and arranged to receive a seal assembly generally identified by the numeral 55. The seal assembly 55 includes an o-ring 56 and two flanking backup rings 58 and 60. The seal assembly 55 achieves a seal between the spring guide 58 and the spring housing 30. The seal assembly 55 also isolates the close chamber 34 from atmosphere. An elongate bore 62 is formed in the spring housing 30 and the central block 22. The elongate bore 62 is sized and arranged to receive the seal carrier 80 discussed below. As shown in the drawing, the diameter of the bore 62 at the arrow L is larger than the diameter of the bore 62 at the arrow S. These different diameters are required because the seal carrier 80 has a big end 64 with a diameter that is larger than the diameter on the little end 66.

Figure 2:
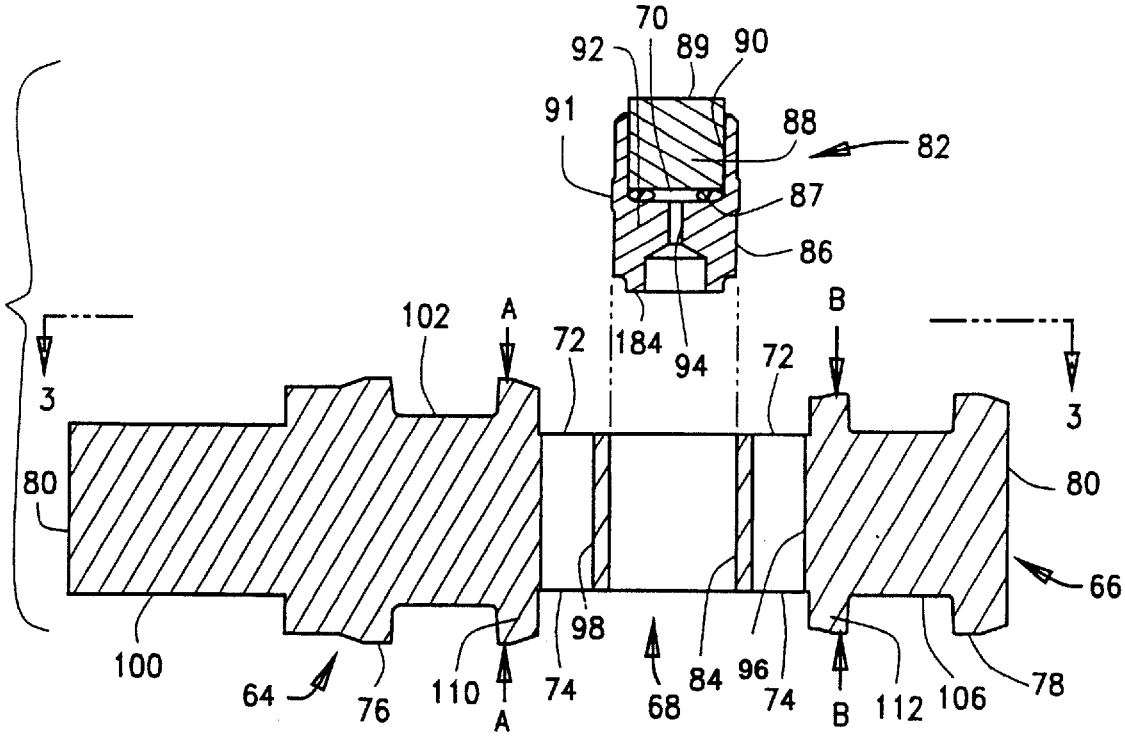
FIG. 2 is a side cross-sectional view of the main seal assembly and seal carrier.

FIG. 2 is a section view of the seal carrier 80 and the main seal assembly generally identified by the numeral 82. The seal carrier 80 has a big end generally identified by the numeral 64, a little end generally identified by the numeral 66 and a mid-section generally identified by the numeral 68. A central bore 84 is formed in the mid-section 68 of the seal carrier 80 and is sized and arranged to receive the main seal assembly 82. A flanking flow passageway 96 is positioned on one side of the central bore 84 and a second flanking passageway 98 is positioned on the opposite side of the central bore 84.

The main seal assembly 82 includes a barrel shaped member 86 and a seal plug 88 positioned in a seal plug bore 90 on one end of the barrel shaped member 86. The seal plug 88 has a bottom 87 and a flat top 89. A bi-directional seal 92 is positioned in the bottom 91 of seal plug bore 90 between the seal plug 88 and the barrel shaped member 86 to achieve a seal between the seal plug 88 and the barrel shaped member 86.

The bi-directional seal 92, can be formed from an elastomeric material such as a 90 durometer buna-n. Microsize o-rings from Apple Rubber Products, Inc. of Lancaster, Pa. may be suitable for this application. For example, an o-ring with a 0.126 inch i.d. and a 0.047 inch crossection may be suitable. Other types of o-rings with other dimensions and durometers may also be suitable for this invention. A barrel flow passageway 94 is formed in the barrel shaped member 86. A seal chamber 70 is defined by the bottom 87 of the seal plug 88, the bottom 91 of the bore 90 in the barrel shaped member 86 and the bi-directional seal 92. Pressurized supply fluid enters the seal chamber 70 when the valve 20 is in the closed position causing the seal assembly 82 to seal properly.

A spring follower 100 is formed on the big end 64 of the sealed carrier 80 and is sized and arranged to receive the spring 48 which is captured between the spring follower 100 and the spring guide 50. The spring 48 urges the seal carrier 80 into the normally closed position of FIGS. 1 and 4.

A channel 102 is formed in the big end 64 of the spring carrier 80 proximate the close chamber 34 and is sized and arranged to receive the first circumferential seal assembly generally identified by the numeral 104 and better seen in FIG. 4. A channel 106 is formed in the spring carrier 80 proximate the open chamber 40. The channel 106 is sized and arranged to receive the second circumferential seal assembly generally identified by the numeral 108 and better seen in FIG. 4.

In order to achieve a latching function, the diameter of the piston 110 formed on the seal carrier 80 and generally identified by the arrows A is larger than the diameter of the piston 112 formed in the seal carrier 80 and generally identified by the arrows B. In the preferred embodiment, the diameter of the large piston 110 could be approximately 0.625 inches and the diameter of the small piston 112 could be approximately 0.562 inches. Other dimensions are within the scope of this invention. The latching function will be described below in connection with FIGS. 4 and 5. A top flat 72 is formed on the top of the mid-section 68 of the seal carrier 80 between pistons 110 and 112. A bottom flat 74 is formed on the bottom of the mid-section 68 of the seal carrier 80 between pistons 110 and 112. The diameter of the seal carrier 80 at rim 76 is the same as the diameter of the piston 110. The diameter of the seal carrier 80 at rim 78 is the same as the diameter of the piston 112.

Figure 3:
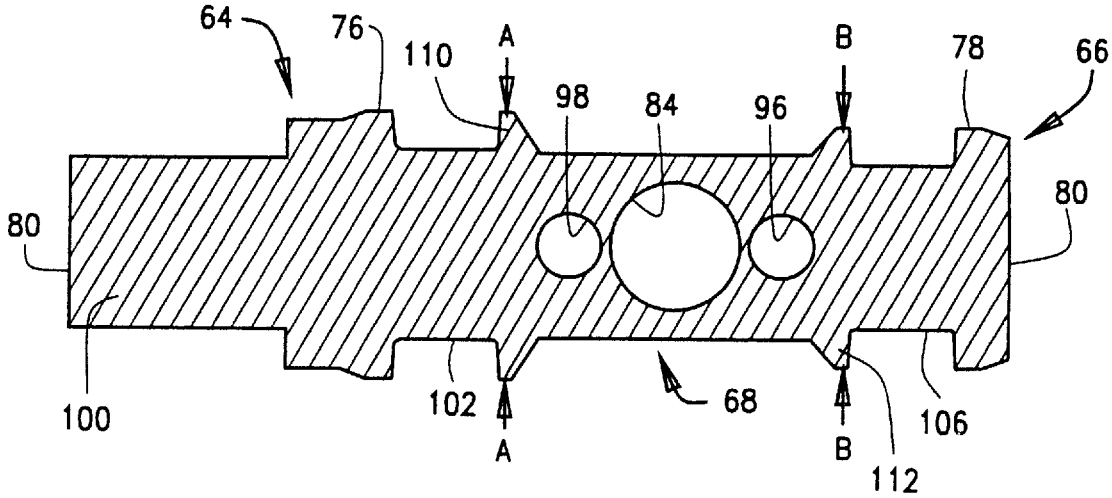
FIG. 3 is a top cross-sectional view of the seal carrier along the line 3—3 of FIG. 2.

FIG. 3 is a top section view of the seal carrier 80 along the line 3—3 of FIG. 2. The central bore 84 passes all the way through the seal carrier 80 and receives the main seal assembly 82 as best seen in FIG. 2. The central bore 84 has a first flanking passageway 96 and a second flanking passageway 98 to facilitate fluid flow when the valve 20 is in the open position. The large piston 110 has a diameter at the arrows A greater than the diameter of the small piston 112 at the arrows B. The diameter of the central bore 84 can be approximately 0.300 inches and the diameter of the flanking passageways can be approximately 0.121 inches. Other dimensions are within the scope of this invention.

FIG. 4 is an enlarged section view of the main seal assembly 82 and surrounding components as circled and indicated by the numeral 4 of FIG. 1. In FIGS. 1 and 4, the valve 20 is shown in the closed position. A supply port 120 is formed in the bottom plate 26. The supply port 120 is connected to the source of pressurized supply fluid, not shown. A vent passageway 121 is in fluid communication with a vent port 232, better seen in FIG. 10. The vent port 232 is vented to atmosphere. In the case of subsea applications, atmosphere means the surrounding sea water. An annular function passageway 123 is in fluid communication with a conduit 125 and a function port 234, better seen in FIG. 10. The function port 234 is in fluid communication with a downstream apparatus, not shown. In subsea valves, both the supply fluid and the pilot fluid are typically water.

When the valve 20 is in the closed position as shown in FIG. 4, pressurized supply fluid is isolated in the supply port 120. The annular function passageway 123 is vented to atmosphere through the vent passageway 121. When the valve is in the open position as shown in FIG. 5, supply fluid flows from the supply port 120 to the annular function passageway 123, the conduit 125 and the function port 234 and thereafter to the downstream apparatus, not shown. The vent passageway 121 is sealed when the valve 20 is in the open position of FIG. 5.

Referring to FIG. 4, the supply seal plate 122 is positioned in a bore 124 in the central block 22. An alignment pin 126 is positioned in the central block 22 and registers with an aperture 127 in the supply seal plate 122 to properly orient the supply seal plate passageway 128 so it is in fluid communication with the supply port 120.

The vent seal plate 132 is positioned in a bore 134 in the central block 22 and is properly aligned by an aligning pin 136 which registers with an aperture 137 in the vent seal plate 132 so the vent seal plate passageway 138 is in fluid communication with the vent passageway 121. A supply seal plate seal groove 140 is formed in the bottom plate 26 and is sized and arranged to receive the supply seal plate seal 142. The supply seal plate seal 142 achieves a seal between the lower plate 26 and the supply seal plate 122. A recess 144 is formed in the central block 22 and is sized and arranged to receive the supply seal plate seal 146. The supply seal plate seal 146 achieves a seal between the supply seal plate 122 and the central block 22.

The first circumferential seal assembly generally identified by the numeral 104 is positioned in the groove 102 of seal carrier 80. The first circumferential seal assembly 104 includes an o-ring 150 flanked by two backup rings 152 and 154. The second circumferential seal assembly generally identified by the numeral 108 includes an o-ring 156 flanked by two backup rings 158 and 160. The seal assembly 108 is positioned in groove 106 of seal carrier 80.

A groove 162 is formed in the central block 22 and is sized and arranged to receive the vent supply seal plate seal 164. The supply seal plate seal 164 makes a seal between the central block 22 and the vent seal plate 132. The valve 20 uses five primary seal assemblies including: a) the main seal assembly 82, b) the first circumferential seal assembly 104, c) the second circumferential seal assembly 108, d) the supply seal plate seal 146 and e) the vent seal plate seal 164.

A supply seal plate seal groove 166 is formed in the top plate 24 and is sized and arranged to receive the supply seal plate seal 168. The supply seal plate seal 168 forms a seal between the top plate 24 and the vent seal plate 132.

A flat sealing surface 180 is formed on one end of the vent seal plate 132. A flat sealing surface is formed on the top 89 of the seal plug 88. The flat sealing surfaces 180 and 89 are lapped to a flat finish to ensure a tight metal-to-metal seal. The flat sealing surface 89 of the seal plug 88 slides across the flat sealing surface 180 of the vent seal plate 132, when the seal carrier 80 shifts from the open to the closed position.

Likewise, a flat sealing surface 182 is formed on one end of the supply seal plate 122. A flat sealing surface 184 is formed on one end of the barrel shaped member 86. Sealing surfaces 182 and 184 are lapped to a flat finish to ensure a good metal-to-metal seal. The flat sealing surface 184 of the barrel shaped member 86 slides across the flat sealing surface 182 of the supply seal plate 122 when the seal carrier 80 shifts from the open to the closed position.

In order to contain pressurized supply fluid in the supply port 120, the following seals are achieved. First, the flat sealing surface 182 of supply seal plate 122 is in sealing engagement with the flat sealing surface 184 of the barrel shaped member 86. The barrel shaped member 86 has a barrel flow passageway 94 to permit fluid communication between the supply port 120, the supply seal plate passageway 128 and the seal chamber 70. When the seal carrier 80 is in the closed position pressurized supply fluid energizes the bi-directional seal 92 and exerts force on the seal plug 88 causing it to seal against the flat surface 180 of the vent seal plate 132 and to exert force on the barrel shaped member 86 causing it to seal against the flat surface 182 of supply seal plate 122. When the valve 20 is closed the annular function passageway 123 and the downstream apparatus, not shown, are in fluid communication with the vent passageway 121. When the valve 20 is closed, the downstream apparatus, not shown, is vented to atmosphere and supply pressure is contained in supply port 120.

In order to shift the valve 20 from the closed position of FIG. 4 to the open position of FIG. 5, a pilot valve, not shown, must open and allow pressurized pilot fluid to enter the open chamber 40. The pressurized pilot fluid in the open chamber 40 overcomes the opposing spring force from spring 48 and shifts the seal carrier 80 from the closed to the open position of FIG. 5.

FIG. 5 is a section view of the main seal assembly generally identified by the numeral 82 and surrounding components. In FIG. 5 the valve 20 is in the open position. In FIG. 5, the vent passageway 121 is closed and pressurized supply fluid flows from the supply port 120 to the annular function passageway 123 through the conduit 125 to the function port 234 and the downstream apparatus, not shown.

In FIG. 5, supply fluid is acting against the large piston 110 and the small piston 112. Because the area of the piston 110 is larger than the piston 112, the valve 20 will stay latched open after the pilot fluid has been vented because of the differential forces acting on the seal carrier 80. Typically, the open pilot valve, not shown, is a two-position, three-way valve. After the open pilot valve has been actuated or pulsed for two to three seconds, it is turned off and the pilot fluid is vented to atmosphere. The pilot fluid in the open chamber 40 is likewise vented to atmosphere through the pilot valve, not shown. However, because of the differential forces of the supply fluid acting upon the seal carrier 80, the valve 20 will remain latched in the open position after the pilot pressure has been vented to atmosphere. The valve 20 will close when the close pilot, not shown, is actuated or if the supply pressure falls below a predetermined set pressure. If supply pressure falls below the set pressure, the close assembly 21 will cause the seal carrier 80 to shift from the open position of FIG. 5 to the closed position of FIG. 4 because the forces of the spring 48 overcome the reduced forces of the supply fluid acting on seal carrier 80.

FIG. 6 is a top plan view of the valve 20. A plurality of socket head cap screws (also commonly referred to as allen head bolts) 200, 202, 204 and 206 extend through the top plate 24, the central block 22, and the bottom plate 26. Socket head cap screws 200, 202, 204 and 206 protrude completely through the valve 20 and facilitate attaching it to a manifold or other apparatus, not shown. The pilot close port 32 is formned in the spring housing 30. The elongate adjusting bolt 52 threadably engages the spring housing 30.

Figure 7:
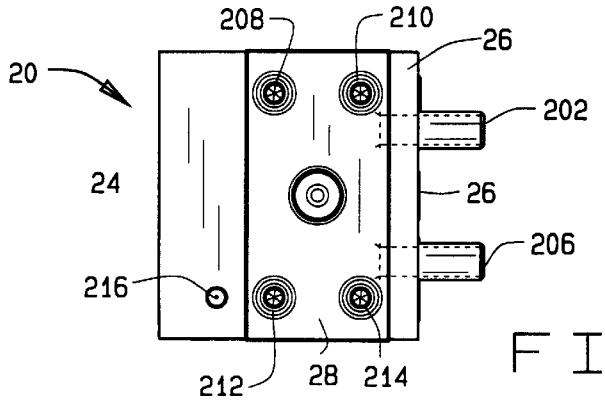
FIG. 7 is an end view of the latching hydroseal valve along the line 7—7 of FIG. 6.

FIG. 7 is an end-view of the valve 20 along the line 7—7 of FIG. 6. A plurality of socket head cap screws (commonly referred to as alien head bolts) 208, 210, 212 and 214 connect the adapter 28 to the central block 22. An expander plug 216 is positioned in the top plate 24. Socket head cap screws 202 and 206 protrude through the valve 20.

Figure 8:
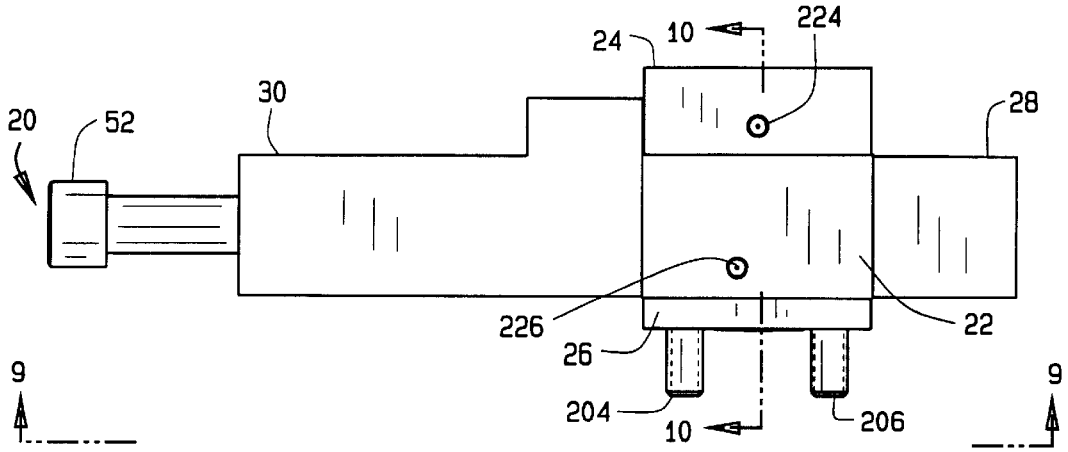
FIG. 8 is a side elevation view of the latching hydroseal valve along the line 8—8 of FIG. 6.

FIG. 8 is a side elevation view of the valve 20 along the line 8—8 of FIG. 6. The spring housing 30 is connected to the central block 22 with socket head cap screws, not shown, in the same fashion that the adapter 28 is secured to the body with socket head cap screws (allen head bolts). Expander plug 224 is positioned in top plate 24 and expander plug 226 is positioned in the central block 22.

Figure 9:
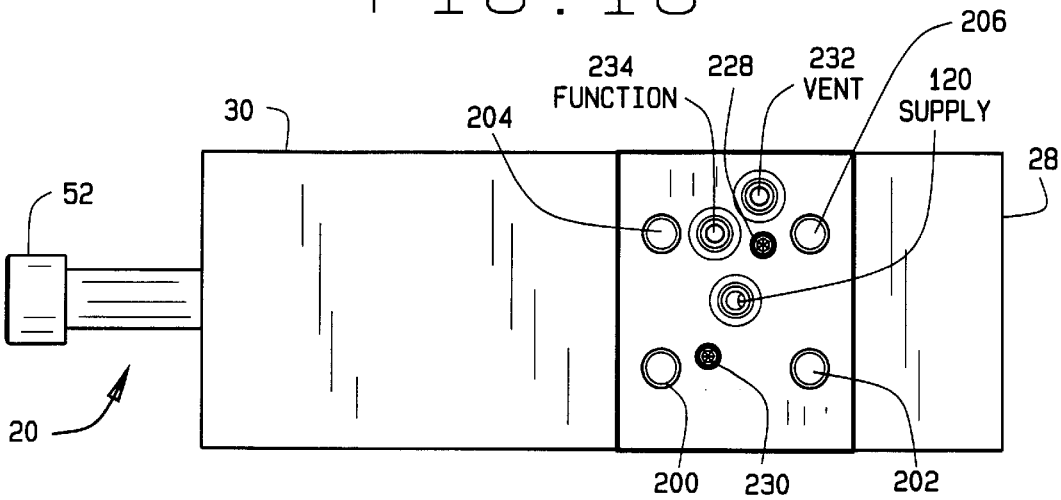
FIG. 9 is a bottom plan view of the latching hydroseal valve along the line 9—9 of FIG. 8.

FIG. 9 is a bottom view of the valve 20. The elongate adjustment bolt 52 threadably engages the spring housing 30. The adapter 28 is bolted to the central block 22, not shown. The four screws 202, 204, 206 and 208 protrude through the valve 20 and facilitate attachment to a manifold or other apparatus. The lower plate 26 is bolted to the central block 22 with socket head cap screws (commonly known as allen head bolts) 228 and 230.

The supply port 120 is formed in the bottom plate 26. A vent port 232 and a function port 234 are likewise formed in the bottom plate 26. The supply port 120 is connected to a source of pressurized supply fluid, not shown. The vent port 232 is vented to atmosphere, which in subsea applications is the surrounding sea water. The function port 234 connects to the downstream apparatus, not shown.

Figure 10:
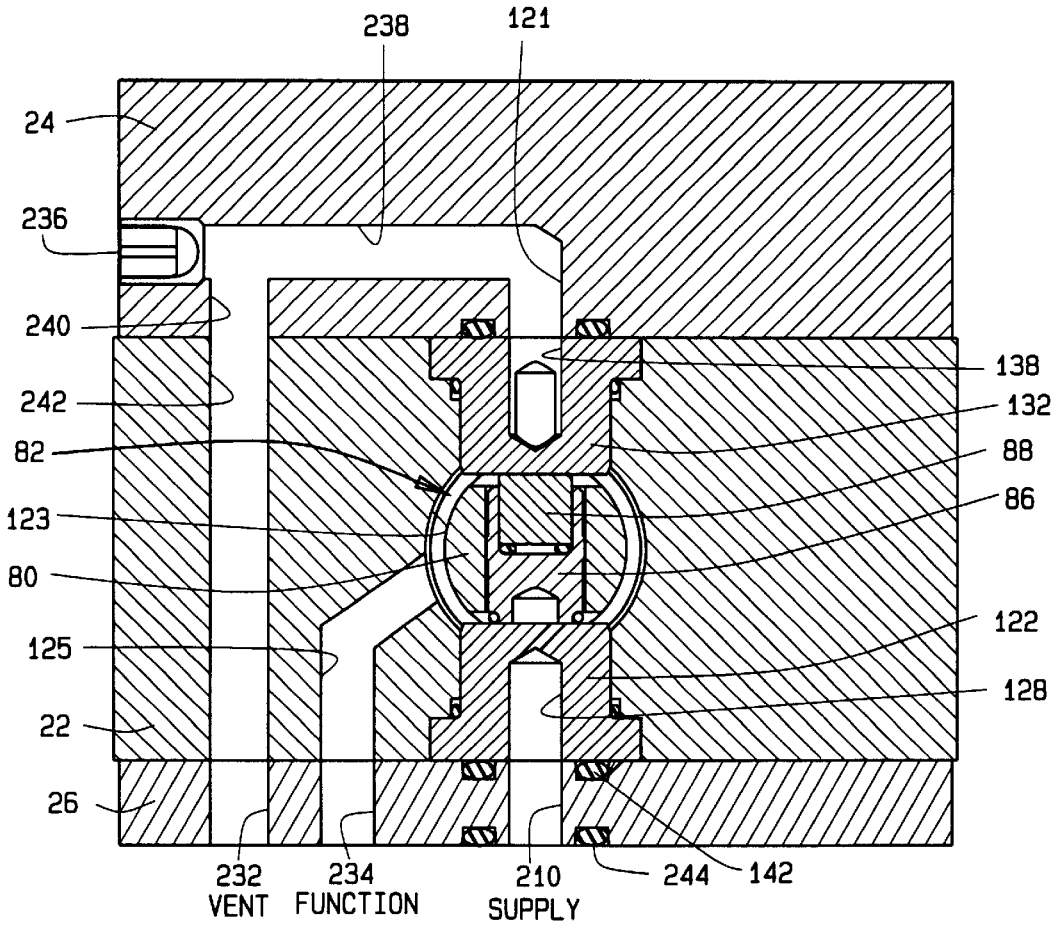
FIG. 10 is a schematic section view of the internal components of the latching hydroseal valve along the line 10—10 of FIG. 8.

FIG. 10 is a schematic section view of the valve 20 along the line 10—10 of FIG. 8. The top plate 24 is positioned on the top of the central block 22 and the bottom plate 26 is positioned on the bottom of the central block 22. A supply port 120, a vent port 232 and a function port 234 are formed in the bottom plate 26. The supply port 120 is in fluid communication with the supply seal plate passageway 128 of the supply seal plate 122. The vent passageway 121 is in fluid communication with the vent seal plate passageway 138 of the vent seal plate 132 and the vent port 232. An expander plug 236 is positioned in the top plate 24 to seal the vent passageway 121 against atmosphere. The vent passageway 121 includes a horizontal bore 238 in the top plate 24, a vertical bore 240 in the top plate 24 and a vertical bore 242 in the central block 22.

The function passageway 123 is an annular area that surrounds the mid-section 68 of the seal carrier 80 and the main seal assembly 82. The function passageway 123 is in fluid communication with the function port 234 via the conduit 125. As shown in FIG. 10, the seal plug 88 engages the vent seal plate 132. The barrel shaped member 86 engages the supply seal plate 122. The supply seal plate seal 142 seals the lower plate 26 against the supply seal plate 122. A second supply seal plate seal 244 seals the lower plate 26 against a manifold, not shown.

Figure 12:
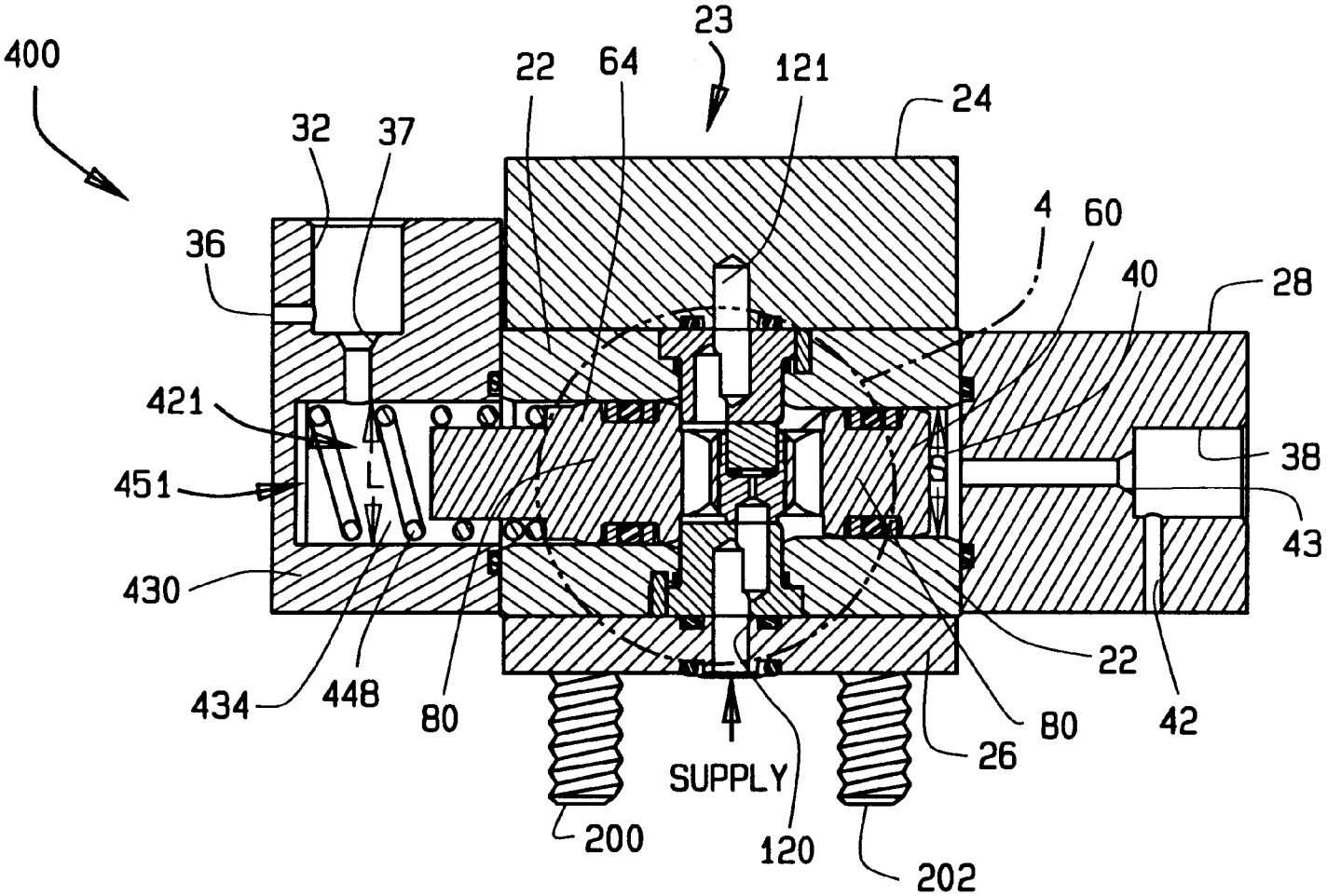
FIG. 12 is a section view of an alternative embodiment of the latching hydroseal valve except the close assembly is not manually adjustable. The latching hydroseal valve in FIG. 12 is shown in the normally closed position.

FIG. 12 is a section view of an alternative embodiment of the latching hydroseal valve 400. The valve 400 in FIG. 12 is shown in the normally closed position.

The valve 400 is similar in many respects to the valve 20 except there is no adjusting bolt 52 or spring guide 50. The close assembly 421 is therefore not manually adjustable in the field. The spring housing 430 in FIG. 12 is much shorter than the spring housing 30 in FIG. 1. Common parts will be identified with common numbers hereinafter.

The latching hydroseal valve 400 is a normally closed 2-position, 3-way valve. It has the same operational ratings and the same applications as the latching hydroseal valve 20.

The latching hydroseal valve 400 is connected to a source of pilot fluid, not shown, which is typically pressurized to approximately 3–10,000 psi. The valve 400 in FIG. 12 includes a close assembly generally identified by the numeral 421 that cannot be manually adjusted in the field to raise or lower the set pressure of the valve. Instead, a specific spring 448 is selected at the factory and installed in the valve 400. Different springs with different spring rates may be used for different set pressures or a standard spring may be selected and a pre-set spacer 451 can be inserted in the spring housing 430 to vary the set pressure. The preset spacer 451 is captured between the spring 448 and the spring housing 430. Spaces with different thickness can be used to compress the spring 448 to different degrees and thus further adjust the set pressure of the valve 400.

In the alternative, different types of springs 448 and spacers 451 with different thicknesses can be used to adjust the set pressure when the valve 400 is manufactured. If the supply pressure unexpectedly drops below a set pressure, for example 750 psi, the valve 400 automatically closes. This is to guard against unanticipated failure of supply pressure. And yet another alternative embodiment, not shown, the valve can be produced without a close assembly 421, although this is not preferred.

Common parts will be identified with common numbers hereinafter. A central block 22 is located in the middle of the valve 20. A top plate 24 is positioned on the top of the central block and a bottom plate 26 is positioned on the bottom of the central block 22. The top plate 24 and the bottom plate 24 are connected to the central block 22 with a plurality of bolts as previously described in connection with valve 20.

An adapter 28 is connected to the central block 22 and a spring housing 430 is connected to the central block 22 opposite the adapter 28. For purposes of claim interpretation, the central block 22, the top plate 24, the bottom plate 26, the adapter 28 and the spring housing 30 will collectively be referred to as the body 23. A close port 32 is formed in the spring housing 430 and is in fluid communication with the close chamber 434. The pilot close port 32 is configured with MP (medium pressure) threads and must have a vent 36 so if leakage occurs past the taper 37, the leak will exit through the vent 36 and will not blow out a fitting, not shown, in the pilot close port 32. Typically an external pilot valve is connected by tubing, not shown, and a fitting, not shown, to the pilot close port 32.

The adapter 28 defines a pilot open port 38, which is fluid communication with an open chamber 40. Likewise, the pilot open port 38 has MP threads that must have a vent 42 so if leakage occurs past the taper 43, pressure will exit through the vent 42 and not blow out a fitting, not shown, in the pilot open port 38. Other types of threads may be used in the pilot close port 32 and the pilot open port 38, as a matter of design choice.

Typically, an upstream pilot valve, not shown, is connected by tubing, not shown, and a fitting, not shown, to the pilot open port 38. To operate the valve 20, the open pilot, not shown, is actuated allowing pilot fluid to enter the open chamber 40 and shift the seal carrier 80 into the open position as shown in FIG. 5. After the pilot valve is closed, the pilot fluid in the open chamber 40 is vented through the pilot valve, not shown to atmosphere. To close the valve 20, a second pilot valve, not shown, is activated, allowing pilot fluid to enter the close chamber 434 and shift the seal carrier 80 into the closed positioned as shown in FIGS. 1 and 4. Inside the close chamber 434 is a spring 448, one end of which engages the seal carrier 80 and the other end of which contacts a pre-set spacer 451 or in the alternative, directly abuts the spring housing 430. The valve 400 operates in the same sequence as the valve 20 previously discussed.

Operational Sequence

Referring to FIG. 1, the latching hydroseal valve 20 is shown in the closed position. In order to open the valve 20, an upstream pilot valve, not shown, is actuated or pulsed for several seconds. This delivers pressurized supply fluid to the open chamber 40 causing the seal carrier 80 to shift to the open position of FIG. 5.

Referring now to FIG. 5, pressurized supply fluid moves through the supply port 120, the supply seal plate passageway 128 and the annular function passageway 123. Referring now to FIG. 10, the pressurized supply fluid flows from the annular function passageway 123 through the conduit 125 to the function port 234 and the downstream apparatus, not shown. When the valve 20 is in the open position, the vent port 232 and the vent passageway 121 are closed by the seal plug 88.

In the open position, the bi-directional seal 92 works as follows. Referring back to FIG. 5, pressurized supply fluid enters the bore 90 between the seal plug 88 and the barrel shaped member 86. The pressurized supply fluid energizes and compresses the bi-directional seal 92 and exerts force against a portion of the bottom 87 of the seal plug 88 not encircled by the seal 92 causing the flat sealing surface 89 of the seal plug 88 to seal against the flat surface 180 of the vent seal plate 132. In addition, the pressurized supply fluid is acting on a portion of the bottom 91 of the bore 90 not encircled by the seal 92 of the barrel shaped member 86. The forces acting on the bottom 91 of the bore 90 cause the flat surface 184 of the barrel shaped member 86 to seal against the flat surface 182 of the supply seal plate 122. In addition, the pressurized supply fluid acts upon the large piston 110 and the small piston 112 latching the seal carrier 80 into the open position because of the differential forces acting on pistons 110 and 112. After the open pilot, not shown, has been actuated or pulsed for several seconds, it will be closed and the pilot fluid will be vented from the open chamber 40 but the seal carrier 80 will remain in the latched open position of FIG. 5 because of the differential forces of the supply fluid acting on pistons 110 and 112.

In order to close the valve 20, the close pilot, not shown, must be actuated or pulsed for several seconds. This causes pressurized pilot fluid to enter the close chamber 34 which together with the force of the spring 48 overcomes the opposing forces generated by the supply fluid on piston 110. Actuation of the close pilot, not shown, causes the seal carrier 80 to shift back to the closed position shown in FIGS. 1 and 4. In the closed position, supply fluid is isolated in the supply port 120. The downstream apparatus, not shown, is vented to atmosphere. This is accomplished as follows: The downstream apparatus is connected to the function port 234, the conduit 125 and the annular function passageway 123 as shown in FIG. 10. The annular function passageway 123 as shown in FIG. 4 is in fluid communication with the vent seal plate passageway 138 and the vent passageway 121 which ultimately connects to the vent port 232 which is vented to atmosphere.

In the closed position, the bi-directional seal works as follows as shown in FIG. 4. Pressurized supply fluid is isolated in the supply port 120 and the supply seal plate passageway 128. However, the pressurized supply fluid moves through the barrel flow passageway 94 into the seal chamber 70. When the pressurized supply fluid enters the seal chamber 70, it energizes the bi-directional seal 92 and expands the seal 92 to the outside circumference of the seal plug bore 90. In addition, the pressurized supply fluid acts upon a portion of the bottom 87 of the seal plug 88 encircled by the seal 92 forcing the seal plug into sealing engagement with the flat sealing surface 180 of the vent seal plate 132. In addition, the pressurized supply fluid acts on a portion of the bottom 93 of the seal plug bore 90 encircled by the seal 92 causing the flat surface 184 of the barrel shaped member 86 into sealing engagement with the flat sealing surface 182 of the supply seal plate 122. In this fashion, the bi-directional seal is energized by pressurized supply fluid when the valve 20 is in the closed position of FIG. 4 and is also energized by pressurized supply fluid when the valve 20 is in the open position of FIG. 5.

Figure 11:
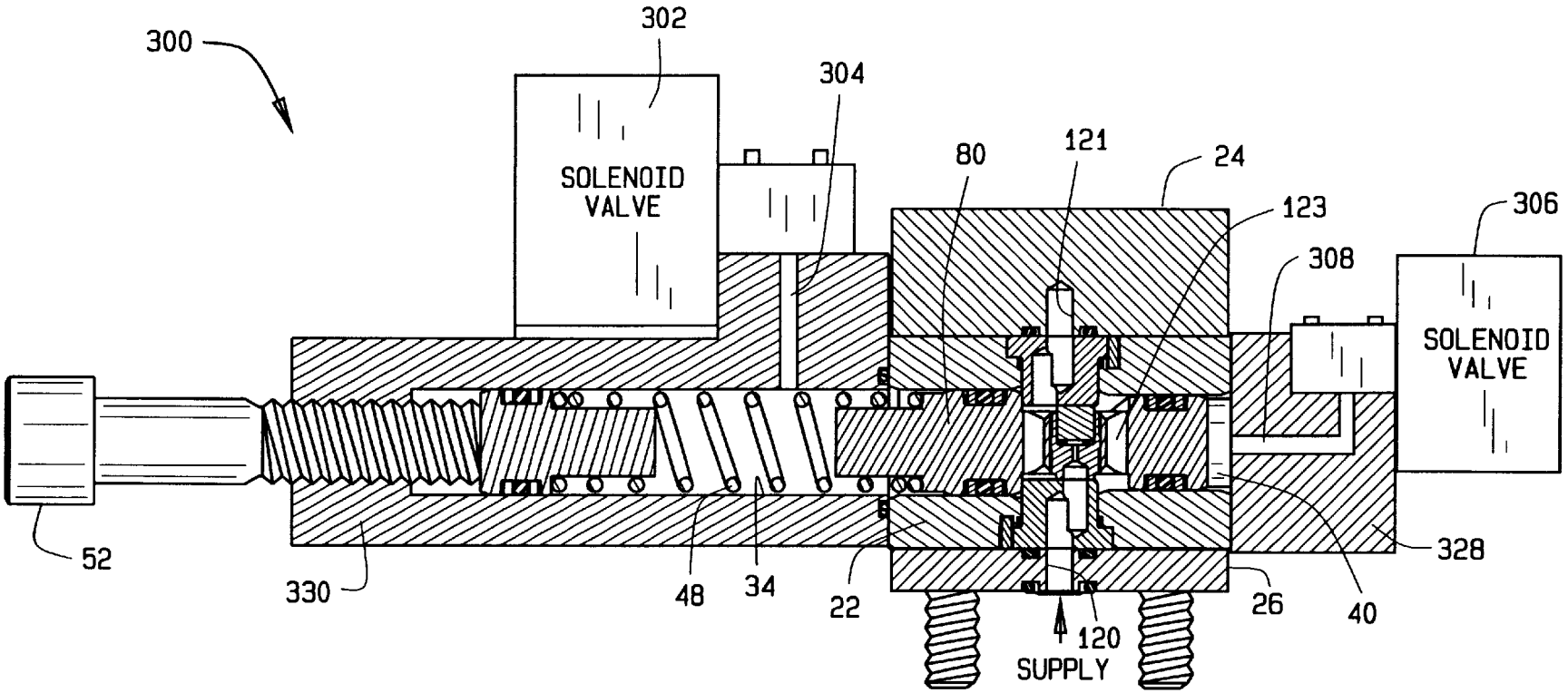
FIG. 11 is a section view of an alternative embodiment of the latching hydroseal valve with integral solenoid pilot valves.

FIG. 11 is a section view of an alternative embodiment of the latching hydroseal valve generally identified by the numeral 300. The only difference between the valve 300 and the valve 20 is the type of pilot valves that are used to actuate the valve 20. The valve 300 has attached solenoid actuated pilots 302 and 306 whereas the valve 20 has remote upstream pilots, not shown.

The valve 300 is constructed substantially the same as the valve 20 and functions in substantially the same fashion. For example, the seal carrier 80 is the same in both valves. In FIG. 11 the valve 300 is shown in the closed position like the valve 20 of FIG. 1. The only significant differences are the types of pilots. The valve 300 has a solenoid actuated close pilot valve 302 which is in fluid communication with the close chamber 34 via a passageway 304 through the slightly redesigned spring housing 330.

A solenoid actuated open pilot valve 306 is in fluid communication with the open chamber 40 via a passageway 308 through a slightly modified adapter 328. When the close pilot valve 302 is actuated or pulsed, the valve 300 moves into the closed position as shown in FIG. 11. When the open pilot valve 306 is actuated, the seal carrier 80 shifts to the open position, not shown. In the open position, pressurized supply fluid flows through the valve 300 to a downstream apparatus, not shown. In the closed position, the pressurized supply fluid is isolated in the supply port 120 and the function port 123 is open to the vent port through the vent passageway 121.

FIG. 12 is a section view of an alternative embodiment of the latching hydroseal valve generally identified by the numeral 400. The valve 400 in FIG. 12 is shown in the normally closed position.

The valve 400 is similar in many respects to the valve 20 except there is no adjusting bolt 52 or spring guide 50. The close assembly 421 is therefore not manually adjustable in the field. The spring housing 430 in FIG. 12 is much shorter than the spring housing 30 in FIG. 1. The latching hydroseal valve 400 is a normally closed 2-position, 3-way valve. It has the same operational ratings and the same applications as the latching hydroseal valve 20.

The latching hydroseal valve 400 is connected to a source of pilot fluid, not shown, which is typically pressurized to approximately 3–10,000 psi. The valve 400 in FIG. 12 includes a close assembly generally identified by the numeral 421 that cannot be manually adjusted in the field to raise or lower the set pressure of the valve. Instead, a specific spring 448 is selected at the factory and installed in the valve 400. Different springs with different spring rates may be used for different set pressures. In an alternative approach, a standard spring may be used in all valves and various spacers can be inserted in the spring housing 430 to vary the set pressure. The spacer 451 is captured between the spring 448 and the spring housing 430. Spacers with different thickness can be used to compress the spring 448 to different degrees and thus adjust the set pressure of the valve 400. For this reason the spacers 451 are sometimes referred to as preset because a specific thickness with a know standard spring will produce a predetermined set pressure.

In yet another alternative embodiment, different types of springs and spacers with different thickness can be used together to establish the set pressure at a predetermined level when the valve 400 is manufactured. If the supply pressure unexpectedly drops below a set pressure, for example 750 psi, the valve 400 automatically closes. This is to guard against unanticipated failure of supply pressure. And yet another alternative embodiment, not shown, the valve can be produced without a close assembly 421, although this is not preferred.

Common parts will be identified with common numbers hereinafter. A central block 22 is located in the middle of the valve 20. A top plate 24 is positioned on the top of the central block and a bottom plate 26 is positioned on the bottom of the central block 22. The top plate 24 and the bottom plate 24 are connected to the central block 22 with a plurality of bolts as previously described in connection with valve 20.

An adapter 28 is connected to the central block 22 and a spring housing 430 is connected to the central block 22 opposite the adapter 28. For purposes of claim interpretation, the central block 22, the top plate 24, the bottom plate 26, the adapter 28 and the spring housing 30 will collectively be referred to as the body 23. A close port 32 is formed in the spring housing 430 and is in fluid communication with the close chamber 434. The pilot close port 32 is configured with MP (medium pressure) threads and must have a vent 36 so if leakage occurs past the taper 37, the leak will exit through the vent 36 and will not blow out a fitting, not shown, in the pilot close port 32. Typically an external pilot valve is connected by tubing, not shown, and a fitting, not shown, to the pilot close port 32.

The adapter 28 defines a pilot open port 38, which is in fluid communication with an open chamber 40. Likewise, the pilot open port 38 has MP threads that must have a vent 42 so if leakage occurs past the taper 43, pressure will exit through the vent 42 and not blow out a fitting, not shown, in the pilot open port 38. Other types of threads may be used in the pilot close port 32 and the pilot open port 38, as a matter of design choice.

Typically, an upstream pilot valve, not shown, is connected by tubing, not shown, and a fitting, not shown, to the pilot open port 38. To operate the valve 20, the open pilot, not shown, is actuated allowing pilot fluid to enter the open chamber 40 which causes the seal carrier 80 to shift into the open position as shown in FIG. 5. After the pilot valve is closed, the pilot fluid in the open chamber 40 is vented through the pilot valve, not shown to atmosphere. To close the valve 20, a second pilot valve, not shown, is activated, allowing pilot fluid to enter the close chamber 434 and shift the seal carrier 80 into the closed positioned as shown in FIGS. 1 and 4. Inside the close chamber 434 is a spring 448, one end of which engages the seal carrier 80 and the other end of which contacts a pre-set spacer 451 or in the alternative, directly abuts the spring housing 430. The valve 400 operates in the same fashion as the valve 20 previously discussed except the set pressure cannot be manually adjusted in the field.

What is claimed is:

1. A latching hydroseal valve connected to at least one source of pressurized pilot fluid and a downstream apparatus, the latching hydroseal valve also connected to a source of pressurized supply fluid to selectively direct such supply fluid to the downstream apparatus in response to fluid signals from the source of pilot fluid, the latching hydroseal valve comprising:

a body defining a supply port, a function port, and a vent port, the supply port connected to the source of pressurized supply fluid, the function port connected to the downstream apparatus and the vent port vented to the atmosphere;

a longitudinal bore in the body sized and arranged to receive an elongate seal carrier, one end of the seal carrier exposed to an open chamber and the other end exposed to a close chamber, the seal carrier moving from a closed position to an open position when pressurized pilot fluid fills the open chamber and the seal carrier moving from the open position to the closed position when pressurized pilot fluid fills the close chamber;

the seal carrier having a first diameter proximate the close chamber and a second diameter proximate the open chamber, both diameters being exposed to supply pressure when the seal carrier is in the open position, the first diameter being greater than the second diameter to latch the seal carrier in the open position because of the differential forces acting on the first diameter;

a supply seal plate positioned in the body, the supply seal plate having a supply seal plate passageway in fluid communication with the supply port and the longitudinal bore and a vent seal plate positioned in the body, the vent seal plate having a vent seal plate passageway in fluid communication with the vent port and the longitudinal bore;

the seal carrier having a central bore sized and arranged to receive a main seal assembly and two flanking bores to facilitate fluid flow from the supply port to the function port when the seal carrier is in the open position;

the main seal assembly having:

a barrel shaped member sized and arranged to fit in the central bore of the seal carrier and to seal against the supply seal plate, a seal plug positioned in a seal plug bore in the barrel shaped member to seal against the vent seal plate and a bi-directional seal positioned in the seal plug bore between the seal plug and the barrel shaped member to achieve a seal between the seal plug and the barrel shaped member;

the barrel shaped member having a barrel flow passageway to permit fluid communication between the supply port, the supply seal plate passageway and a seal chamber when the seal carrier is in the closed position so pressurized supply fluid can energize the bi-directional seal and exert force on the seal plug causing it to seal against the vent seal plate and to exert force on the barrel shaped member causing it to seal against the supply seal plate so the function port is in fluid communication with the vent port; and when the seal carrier is in the open position pressurized supply fluid flows from the supply port, through the supply seal plate passageway, the flanking bores, the longitudinal bore to the function port and to the downstream apparatus and the pressurized supply fluid also energizes the bi-directional seal in the seal assembly and exerts force on the seal plug causing it to seal against the vent seal plate and close the vent seal plate passageway and the pressurized supply fluid also exerts force on the barrel shaped member causing it to seal against the supply seal plate.

2. The apparatus of claim further including a close assembly to shift the seal carrier into the closed position if the source of pressurized supply fluid falls below a set pressure.

3. The apparatus of claim 2 wherein the close assembly includes a main spring with a fixed set pressure.

4. The apparatus of claim 3 further including a preset spacer to further adjust the set pressure.

5. The apparatus of claim 2 wherein the close assembly can be manually adjusted to raise or lower the set pressure.

6. The apparatus of claim 5 wherein the close assembly includes an elongate adjusting bolt threaded through the body and extending into the longitudinal bore, a spring follower positioned in the longitudinal bore and bearing against one end of the elongate bolt and a main spring captured between the spring follower and the seal carrier, so clockwise rotation of the elongate bolt increases the set pressure at which the close assembly forces the seal carrier into the closed position and counterclockwise rotation of the elongate bolt decreases the set pressure at which the close assembly forces the seal carrier into the closed position if the source of pressurized fluid falls below the set pressure.

7. The apparatus of claim 1 wherein a lapped sealing surface is formed on the supply seal plate and the barrel shaped member along an area of sliding contact and a lapped sealing surface if formed on the vent seal plate and the seal plug along an area of sliding contact to facilitate a fluid tight metal to metal seal.

8. The apparatus of claim 1 further including:

a first circumferential seal assembly positioned around the seal carrier between the first diameter and the close chamber, to make a seal between the seal carrier and the body and a second circumferential seal assembly positioned around the seal carrier between the second diameter and the open chamber to make a seal between the seal carrier and the body so that pressurized supply fluid does not reach the close chamber and open chamber;

a supply seal plate seal positioned between the supply seal plate and the body to make a seal between the supply seal plate and the body; and a vent seal plate seal positioned between the vent seal plate and the body to make a seal between the vent seal plate and the body.

9. A latching hydroseal valve connected to an open pilot valve, a close pilot valve and a downstream apparatus, the pilot valves connected to a source of pressurized pilot fluid and the latching hydroseal valve connected to a source of pressurized supply fluid to selectively direct such supply fluid to the downstream apparatus in response to fluid signals from the pilot valves, the latching hydroseal valve comprising:

a body defining a supply port, a function port, and a vent port, the supply port connected to the source of pressurized supply fluid, the function port connected to the downstream apparatus and the vent port vented to the atmosphere;

a longitudinal bore in the body sized and arranged to receive an elongate seal carrier, one end of the seal carrier exposed to an open chamber and the other end exposed to a close chamber, the open chamber in fluid communication with the open pilot valve to shift the seal carrier to an open position when pressurized pilot fluid fills the open chamber, and the close chamber in fluid communication with the close pilot valve to shift the seal carrier to a closed position when pressurized pilot fluid fills the close chamber;

the seal carrier having a first diameter proximate the close chamber and a second diameter proximate the open chamber, both diameters being exposed to supply pressure when the seal carrier is in the open position, the first diameter being greater than the second diameter to latch the seal carrier in the open position because of the differential forces acting on the first diameter;

a supply seal plate positioned in the body, the supply seal plate having a supply seal plate passageway in fluid communication with the supply port and the longitudinal bore and a vent seal plate positioned in the body, the vent seal plate having a vent seal plate passageway in fluid communication with the vent port and the longitudinal bore;

the seal carrier having a central bore sized and arranged to receive a main seal assembly and two flanking bores to facilitate fluid flow from the supply port to the function port when the seal carrier is in the open position;

the main seal assembly having a barrel shaped member sized and arranged to fit in the central bore of the seal carrier and to seal against the supply seal plate, a seal plug positioned in a seal plug bore in the barrel shaped member to seal against the vent seal plate and a bi-directional seal positioned in the seal plug bore between the seal plug and the barrel shaped member to achieve a seal between the seal plug and the barrel shaped member;

the barrel shaped member having a barrel flow passageway to permit fluid communication between the supply port, the supply seal plate passageway and a seal chamber when the seal carrier is in the closed position so pressurized supply fluid can energize the bi-directional seal and exert force on the seal plug causing it to seal against the vent seal plate and to exert force on the barrel shaped member causing it to seal against the supply seal plate so the function port is in fluid communication with the vent port; and when the seal carrier is in the open position pressurized supply fluid flows from the supply port, through the supply seal plate passageway, the flanking bores, the longitudinal bore to the function port and to the downstream apparatus and the pressurized supply fluid also energizes the bidirectional seal in the seal assembly and exerts force on the seal plug causing it to seal against the vent seal plate and close the vent seal plate passageway and the pressurized supply fluid also exerts force on the barrel shaped member causing it to seal against the supply seal plate.

10. The apparatus of claim 9 further including a close assembly to shift the seal carrier into the closed position if the source of pressurized supply fluid falls below a set pressure.

11. The apparatus of claim 10 wherein the close assembly includes a main spring with a fixed set pressure.

12. The apparatus of claim 11 further including a preset spacer to further adjust the set pressure.

13. The apparatus of claim 10 wherein the close assembly can be manually adjusted to raise or lower the set pressure.

14. The apparatus of claim 13 wherein the close assembly includes an elongate screw threaded through the body and extending into the longitudinal bore, a spring follower positioned in the longitudinal bore and bearing against one end of the elongate screw and a spring captured between the spring follower and the seal carrier, so clockwise rotation of the elongate screw increases the set pressure at which the close assembly forces the seal carrier into the closed position and counterclockwise rotation of the elongate screw decreases the set pressure at which the close assembly forces the seal carrier into the closed position if the source of pressurized fluid falls below the set pressure.

15. The apparatus of claim 9 wherein a lapped sealing surface is formed on the supply seal plate and the barrel shaped member along an area of sliding contact and a lapped sealing surface if formed on the vent seal plate and the seal plug along an area of sliding contact to facilitate a fluid tight metal to metal seal.

16. The apparatus of claim 9 further including:

a first circumferential seal assembly positioned around the seal carrier between the first diameter and the close chamber, to make a seal between the seal carrier and the body and a second circumferential seal assembly positioned around the seal carrier between the second diameter and the open chamber to make a seal between the seal carrier and the body so that pressurized supply fluid does not reach the close chamber and open chamber;

a supply seal plate seal positioned between the supply seal plate and the body to make a seal between the supply seal plate and the body; and a vent seal plate seal positioned between the vent seal plate and the body to make a seal between the vent seal plate and the body.

17. A latching hydroseal valve with attached solenoid operated open pilot valve and solenoid operated close pilot valve, the latching hydroseal valve connected to a downstream apparatus and the solenoid operated pilot valves connected to a source of pressurized pilot fluid, the latching hydroseal valve connected to a source of pressurized supply fluid to selectively direct such supply fluid to the downstream apparatus in response to fluid signals from the pilot valves, the latching hydroseal valve comprising:

a body defining a supply port, a function port, and a vent port, the supply port connected to the source of pressurized supply fluid, the function port connected to the downstream apparatus and the vent port vented to the atmosphere;

a longitudinal bore in the body sized and arranged to receive an elongate seal carrier, one end of the seal carrier exposed to an open chamber and the other end exposed to a close chamber, the open chamber in fluid communication with the open pilot valve to shift the seal carrier to an open position when pressurized pilot fluid fills the open chamber, and the close chamber in fluid communication with the close pilot valve to shift the seal carrier to a closed position when pressurized pilot fluid fills the close chamber;

the elongate seal carrier having a big end, a mid-section and a little end;

the elongate seal carrier having a first circumferential groove positioned in the big end between a first diameter and the close chamber, the first circumferential groove sized and arranged to receive a first circumferential seal assembly and the elongate seal carrier having a second circumferential groove positioned in the little end between a second diameter and the open chamber, the second circumferential groove sized and arranged to receive a second circumferential seal assembly, both diameters being exposed to pressurized supply fluid when the seal carrier is in the open position, the first diameter being greater than the second diameter to latch the seal carrier in the open position because of the differential forces acting on the first diameter;

a supply seal plate positioned in the body, the supply seal plate having a supply seal plate passageway in fluid communication with the supply port and the longitudinal bore and a vent seal plate positioned in the body, the vent seal plate having a vent seal plate passageway in fluid communication with the vent port and the longitudinal bore;

a supply seal plate seal positioned between the supply seal plate and the body to make a seal between the supply seal plate and the body and a vent seal plate seal positioned between the vent seal plate and the body to make a seal between the vent seal plate and the body;

the mid-section of the seal carrier having a central bore sized and arranged to receive a main seal assembly and two flanking bores to facilitate fluid flow from the supply port to the function port when the seal carrier is in the open position;

the main seal assembly having a barrel shaped member sized and arranged to fit in the central bore of the seal carrier and to seal against the supply seal plate, a seal plug positioned in a seal plug bore in the barrel shaped member to seal against the vent seal plate and a bi-directional seal positioned in the seal plug bore between the seal plug and the barrel shaped member to achieve a seal between the seal plug and the barrel shaped member;

the barrel shaped member having a barrel flow passageway to permit fluid communication between the supply port, the supply seal plate passageway and a seal chamber when the seal carrier is in the closed position so pressurized supply fluid can energize the bi-directional seal and exert force on the seal plug causing it to seal against the vent seal plate and to exert force on the barrel shaped member causing it to seal against the supply seal plate so the function port is in fluid communication with the vent port; and when the seal carrier is in the open position pressurized supply fluid flows from the supply port, through the supply seal plate passageway, the flanking bores, the longitudinal bore to the function port and to the downstream apparatus and the pressurized supply fluid also energizes the bi-directional seal in the seal assembly and exerts force on the seal plug causing it to seal against the vent seal plate and close the vent seal plate passageway and the pressurized supply fluid also exerts force on the barrel shaped member causing it to seal against the supply seal plate.

18. The apparatus of claim 17 further including a close assembly to shift the seal carrier into the closed position if the source of pressurized fluid falls below a set pressure.

19. The apparatus of claim 18 wherein the close assembly includes a main spring with a predetermined set pressure.

20. The apparatus of claim 19 further including a preset spacer to further adjust the set pressure.

21. The apparatus of claim 18 wherein the close assembly can be manually adjusted to raise or lower the set pressure.

22. The apparatus of claim 21 wherein the close assembly includes an elongate adjusting bolt threaded through the body and extending into the longitudinal bore, a spring follower positioned in the longitudinal bore and bearing against one end of the elongate bolt and a spring captured between the spring follower and the seal carrier, so clockwise rotation of the elongate bolt increases the set pressure at which the close assembly forces the seal carrier into the closed position and counterclockwise rotation of the elongate bolt decreases the set pressure at which the close assembly forces the seal carrier into the closed position if the source of pressurized fluid falls below the set pressure.

23. The apparatus of claim 17 wherein a lapped sealing surface is formed on the supply seal plate and the barrel shaped member along an area of sliding contact and a lapped sealing surface is formed on the vent seal plate and the seal plug along an area of sliding contact to facilitate a fluid tight metal to metal seal.

* * * * *

UNITED STATES PATENT AND TRADEMARK OFFICE

CERTIFICATE OF CORRECTION

PATENT NO. : 6,474,362 B1
DATED : November 5, 2002
INVENTOR(S) : Hope, Rodney C. et al.

It is certified that error appears in the above-identified patent and that said Letters Patent is hereby corrected as shown below:

Title page,
Item [75], Inventor, "Rick Whorton" delete "Willow Pine" and replace with -- Spring --;

Column 4,
Line 22, delete the repeated sentence "embodiment, not shown, the valve can be produced without a close assembly, although this is not preferred."

Column 14,
Line 35, after the word claim add -- 1 --.

Signed and Sealed this

Eighteenth Day of March, 2003

JAMES E. ROGAN
*Director of the United States Patent and Trademark Office*